US005199478A

United States Patent [19]

Kubota

[11] Patent Number: 5,199,478

[45] Date of Patent: Apr. 6, 1993

[54] AIR-TIGHTENING DEVICES IN FOLDING DOORS AND WINDOWS

[75] Inventor: Kenichi Kubota, Sabae, Japan

[73] Assignee: Nichimen Corporation, Japan

[21] Appl. No.: 850,631

[22] Filed: Mar. 13, 1992

[30] Foreign Application Priority Data

Oct. 12, 1991 [JP] Japan ..... 3-91458[U]

[51] Int. Cl.[5] ..... E06B 7/16

[52] U.S. Cl. ..... 160/40; 160/229.1

[58] Field of Search ..... 160/40, 199, 206, 229.1; 16/366, 355, 356, 387, 390

[56] References Cited

U.S. PATENT DOCUMENTS

| | | | |
|---|---|---|---|
| 2,882,564 | 4/1959 | Couse et al. | 160/40 |
| 4,660,613 | 4/1987 | Dagenais | 160/199 |
| 5,099,904 | 3/1992 | Susnar | 160/199 |

*Primary Examiner*—Blair M. Johnson
*Attorney, Agent, or Firm*—Schlesinger Arkwright & Garvey

[57] ABSTRACT

Air-tightening devices for folding doors and windows which are consisted of a plurality of panels connected by joint members to swivel about shafts received by bearing flanges of the joint members so that they are stretched or folded. The shafts and their bearing flanges are located outside of the plane of panels. Filler wedges air-tightly embracing said shafts and bearing flanges have smoothly resilient extensions which are coplanar with said plane and are able to make air-tight abutment with sealing liners fitted to lintel rails, independently from another sealing liners provided to lateral sides of the joint members and/or of the panels and being able to make air-tight abutment with the other sides when the panels are stretched.

2 Claims, 8 Drawing Sheets

AIR-TIGHTENING DEVICES IN FOLDING DOORS AND WINDOWS

BACKGROUND OF THE INVENTION

This invention relates to air-tightening devices in joint members connecting panels of folding or collapsible doors and windows. Such doors and windows are required recently not only for parting spaces but also for hermetically closing one from another. In other words, especially when they are used as doors or windows which shut off a room from the outside, they are to be air- and water-tight. In order to achieve this end, sealing means are generally provided to upper and lower lintel rails which coact with such doors or windows, and another sealing means are provided to the joint members of the doors or windows so that when they are closed, the sealing means close the panels air-tightly, leaving no space therebetween. Prior examples of such air-tightening devices for folding doors and windows are described in Japanese Preliminary Utility Model Publications No. Sho-60-159191 and No. Hei-3-40484.

Folding doors and windows are mostly consisted of a plurality of vertically extending panels which are connected each other by joint members so that they are collapsible or bendable. Journals provided to the joint members for allowing the panels to make bending or folding movements, are generally located within a width or thickness of the panels or very adjacently to the panels. In other words, swivels for the panels are located within a locus of their movements. Such provision necessiates small cut-outs or openings between the journals, panels, and joint members, or it needs to round off the angles or to trim the corners of the panels or joint members. Otherwise, the panels can not be swiveled without being interfered or striken by the corners of the joint members. Rounded angles or trimmed corners produce openings between the door and sealing means provided to lintel rails, resulting in adversely affecting air- and water-tightness of the folding doors.

In Japanese Utility Model Post-Examination Publication No. Hei-1-9919, there is disclosed an air-tightening device for a double folding window. Since this window has swiveling shafts protruded outwardly from joint members and panels, it does not need openings such as discussed above. However, since sealing means fitted to panel frames so as to extend vertically along their entire length are designed to protrude outwardly from the frames and to abut at their upper and lower ends, against another sealing means embedded in lintel rails, small openings are to be left between the panel frames and the corresponding joint members for allowing the first-mentioned sealing means to protrude outwardly and to make such outward abutment. And, as the first-mentioned sealing means are provided to the panel frames protrudedly therefrom, they are pressed against the rails so heavily and excessively that they prevent the window from sliding linearly. When the panels are folded one by one, it is required often to move some of them linearly, while they are kept stretched. Hence, it is desired to allow the folding door to smoothly linearly slide even when some of its panels are kept stretched.

BRIEF SUMMARY OF THE INVENTION

In view of such drawbacks accompanied to conventional folding doors and windows as briefly explained above, this invention is to provide folding doors and windows having a plurality of panels connected in alignment by joint members so as to be foldable, swivels of which panels are located outside of planes of the panels and joint members, and hermetic sealing of which panels against the joint members is effected by sealing means acting between them; with novel air-tightening devices comprising filler wedges fitted to bearing flanges which support the swivels of the panels and which are provided to middle parts of the joint members for closing upper and lower openings of said bearing flanges, said wedges being provided with extensions which are coplanar with the planes of the panels and which extend so as to be able to make abutment with another sealing means provided along lintel rails for providing another hermetic sealing between the joint members and the rails independently from the first-mentioned hermetic sealing of the panels against the joint members.

The air-tightening devices made in accordance with this invention and having construtions described above, can provide an additional sealing. That is, when lateral sides of the above-mentioned extensions are abutted against lateral sides of the adjoining panels, hermetic sealing between them is also assured. Further additional sealing can be provided in this invention. That is, when rear edge sides of the extensions are brought into abutment with upper and lower parts of the aforementioned another sealing means, hermetic sealing therebetween is assured additionally.

Thus, the air-tightening divices for folding doors and windows made in accordance with this invention can afford complete hermetic sealings without any openings between the constituent members, and can assure smooth sliding movements of the doors and windows.

BRIEF DESCRIPTION OF DRAWING

FIG. 2-B is a perspective view similar to FIG. 2-A but the window being partially folded;

DETAILED DESCRIPTION OF EXAMPLE

Air-tightening devices for folding doors or windows made in accordance with this invention are explained more in detail and concrete in the following, with reference to the accompanying drawing.

Figure 8:
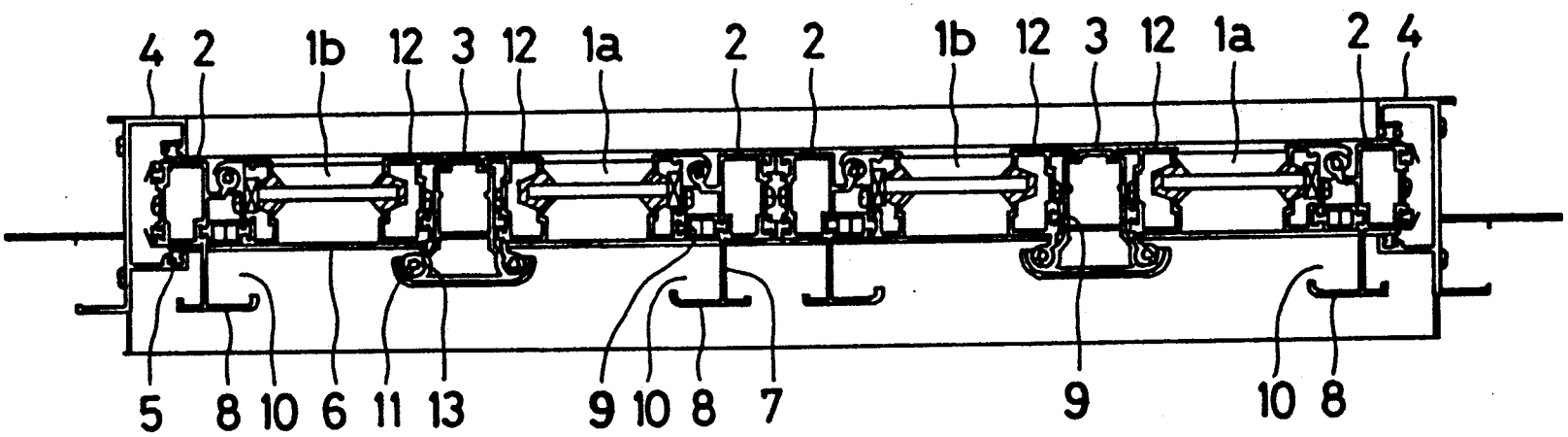
FIG. 8 is a sectional plan view of the window as a whole. 10

In FIG. 8, there is shown an embodiment of a two-splitable folding window which is provided with air-tightening devices made in accordance with this invention, and panels of which are stretched to completely close a window frame opening. The folding window is consisted of, as shown in FIG. 8, two sheets of panels 1*a*, 1*b* respectively at each right and left sides of the window, each sides being connected at their outer ends with handle frames 2, 2, and there being provided joint members 3 between the panels 1*a* and 1*b*. The folding window is mounted to a window frame consisted of lintels and jambs. When the central or inner handle frames 2, 2 are brought into abutment to each other to close the window frame opening, positive air- and water-tightness are assured in this invention.

First sealing means 5, 6 which are made of resilient synthetic materials, are lined to upper and lower lintel rails and also to left and right jambs 4, all of which constitute a window frame, so that said materials can be disposed closely at inner and circumferential edges of the folding window for preventing wind and rain from coming inside a room, when the window is closed. To forward ends of arms 7 which extend inwardly from the handle frames 2, there are formed handles 8. The handles 8 extend to such width sufficient enough to cover second sealing means 9 which are also made of resilient synthetic materials and are fixedly fitted to lateral side faces of the handle frames and of the panel frames. The handles 8 are apart from the panels to have spaces 10 which are of such dimensions that can prevent fingers from being pinched between the second sealing members 9, 9 when the folding window is open or shut by fingers put on the handle.

The joint members 3 connected at their left and right sides with the panels 1*a*, 1*b*, project inwardly of the panels to form bearing flanges 11, 11, in which swivels 13 likewise projected inwardly from vertical frames 12 of panels are insertedly and rotatably fitted.

Figure 1:
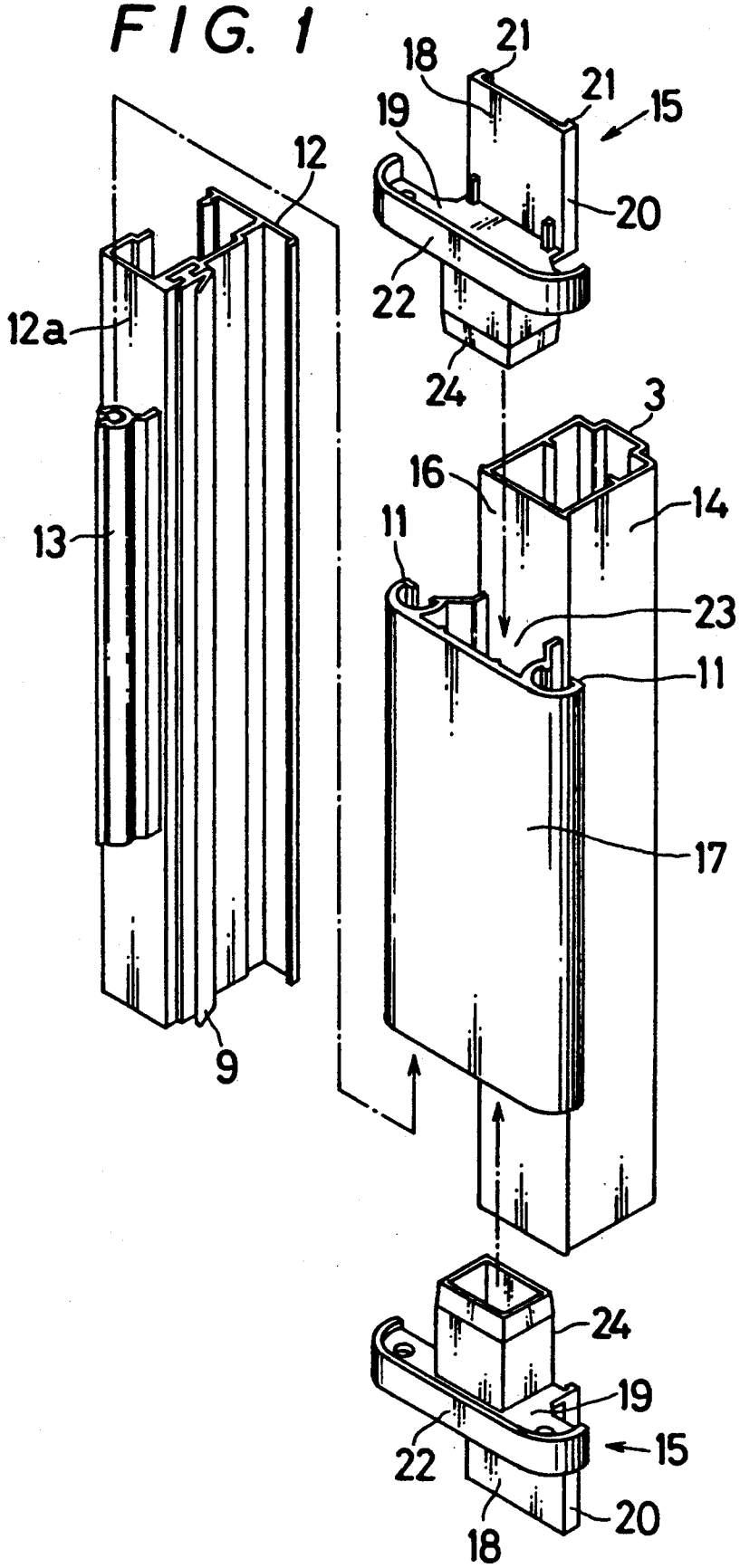
FIG. 1 is a perspective view of principal constituent members of folding window embodying air-tightening devices made in accordance with this invention, which are disassembled.
Figure 2A:
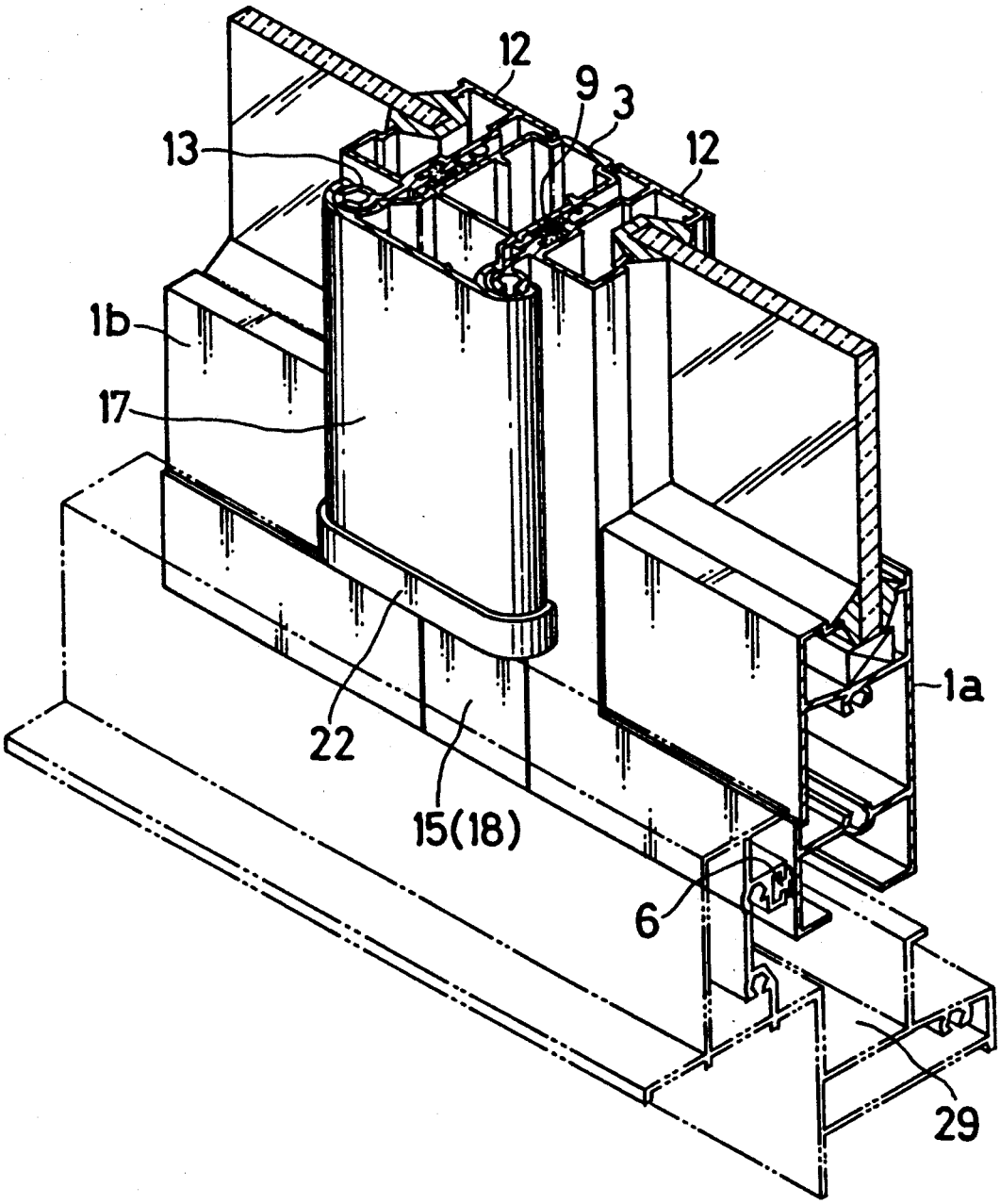
FIG. 2-A is a perspective view of the folding window embodying the air-tightening devices of this invention, the window being closed.
Figure 2B:
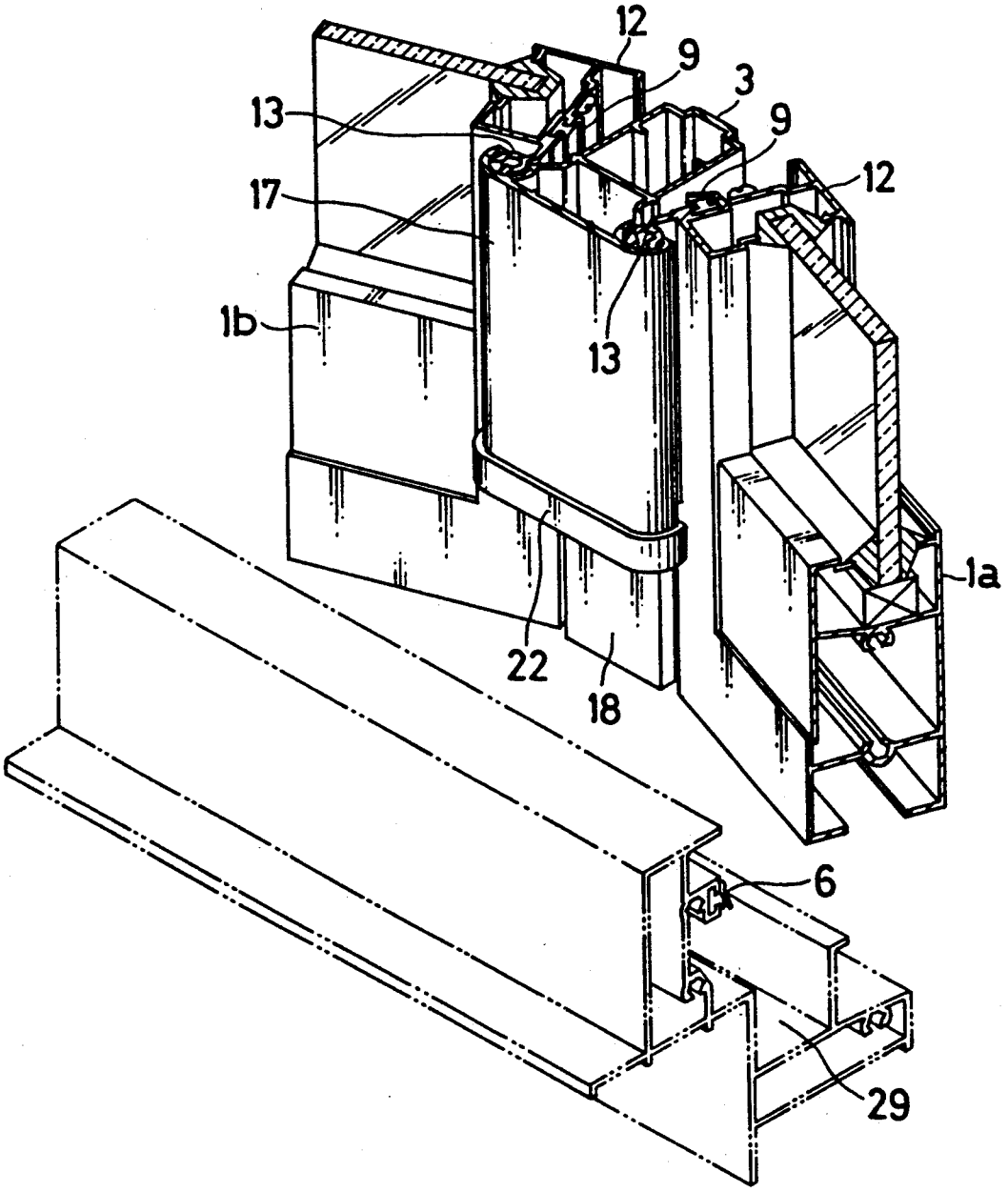
Figure 3:
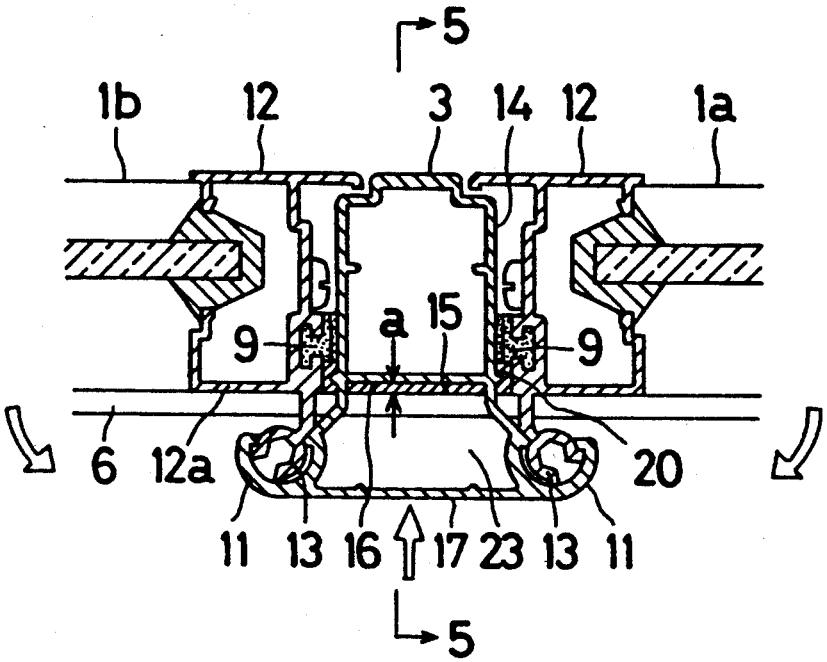
FIG. 3 is a cross-sectional and explanatory plan view of the window shown in FIG. 2-A.
Figure 4:
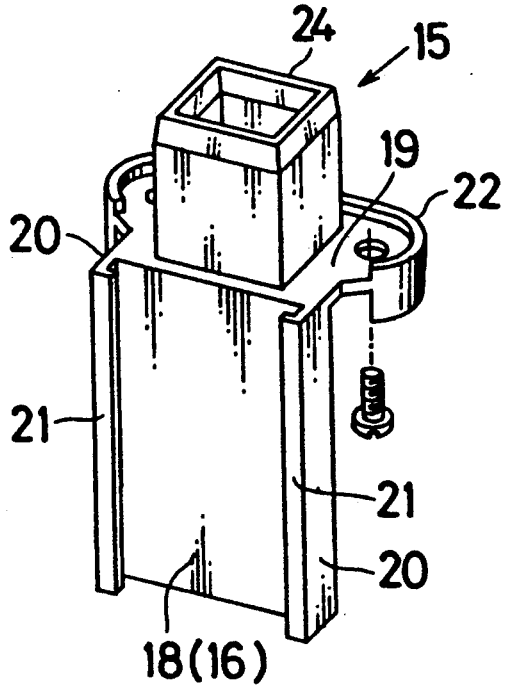
FIG. 4 is a perspective view of a filler wedge employed in the air-tightening devices made in accordance with this invention.
Figure 5:
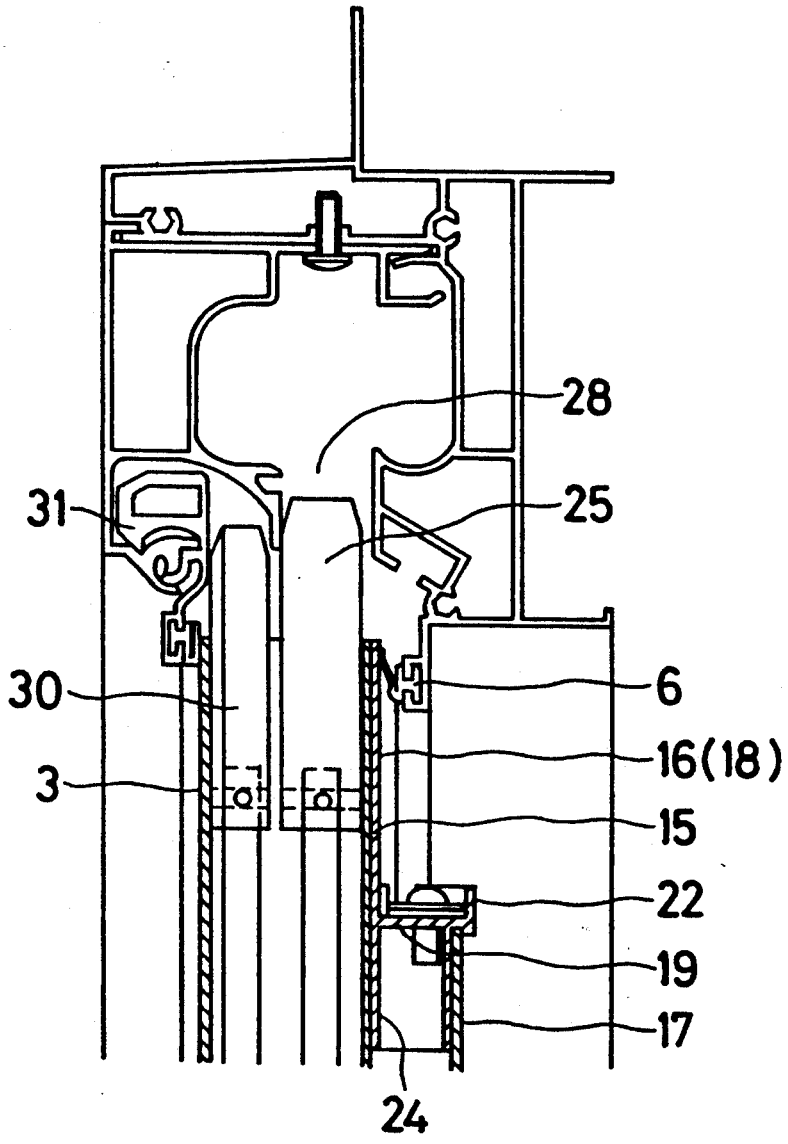
FIG. 5 is a sectional view of the upper part of FIG. 3 taken along the line A—A.
Figure 6:
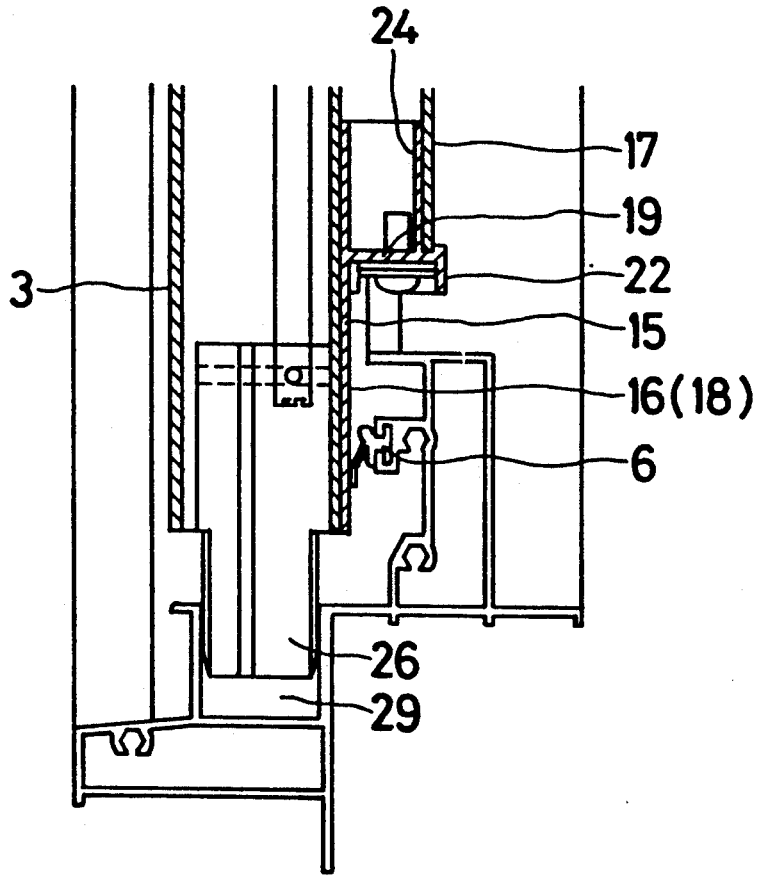
FIG. 6 is view same to FIG. 5, but of its lower part.

Detailed structures of the joint members 3 made in accordance with this invention are shown in FIGS. 1 to 3. The above-mentioned vertical square pillar-like panel frames 12 are fitted, at lateral sides thereof facing to the joint members 3, with the sealing means 9 which come to make a close abutment with the corresponding lateral sides of the joint members when the window is stretched and closed. As best shown in FIG. 1, to each of upper and lower inner ends of the joint members 3, there is insertedly fitted a filler wedge 15 having such structures as shown in FIG. 4.

The outer surface 16 of the joint member 3, from which the bearing flange 11 projects outwardly, is recessed from an outer surface 12*a* of the vertical panel frame 12 as much as a width a shown in FIG. 3, so that the filler wedge 15 having a tongue 18 of a thickness corresponding to said width a can be coplanar with the said outer surface 12*a* of the vertical panel frame 12. Accordingly, the first sealing means 6 provided to the upper and lower lintel rails, can make a close abutment with the joint members 3 air- and water-tightly without any opening therebetween when the window is closed. It will be noted also that since the filler wedge 15 has at its middle portion a U-shaped cross-section, it can be fitted to the joint member so as to embrace the latter, leaving no opening between it and the second sealing means 9, and pressedly abutting also with a part of the lateral side of vertical panel frame 12.

In FIG. 2-A and FIG. 3, there is shown the folding window completely closed or stretched. From this stretched position, the door can be folded by moving the joint members 3 and the panels 1*a*, 1*b* respectively in directions shown by arrows in FIG. 3. As shown also in FIG. 2-B, the panels e1*a*, 1*b* make bending movements about the swivels 13 so as to be folded, when a connector 17 bifurcated into the bearing flanges 11 is mannually pressed inwardly. With said bending movements, the lateral sides of vertical panel frames 12 which have confronted each other with the joint member 3 therebetween, are made apart from the lateral sides of the joint memeber 14, resulting in making the second sealing means 9 also apart from the lateral sides 14 of the joint member, against which said means have made abutment.

The panels 1*a*, 1*b* which have been thus folded, can be stretched again by sliding them laterally by the handle frame 2. The panels make returning rotary movements about the swivels 13 which are located outside of a range in which the panels are moved in relation with the corresponding joint member so as to make abutment with or apart from said member, whereby when they complete the returning movements, the second sealing means 9 fitted vertically longitudinally along the lateral sides of the vertical panel frames 12, come to close abutments with the corresponding lateral sides 14 and filler wedges 15 of the joint members 3. With said movements of panels 1*a*, 1*b*, the upper and lower wedges 15 come to make abutments with the first sealing means embedded in the upper and lower lintel rails.

As described above, the filler wedges 15 having at their middle portions U-shaped cross-sections are fittable to the joint members 3 by embracing them, whereby they will not be slipped off from the lateral surfaces 16 of the joint members. And, the filler wedge having a L-shaped vertical cross-section is provided at the bottom of said L-shape with a horizontally extending socket 19 which works to close openings of the bearing flanges and the connector 17.

For example as best shown in FIG. 4, said filler wedge 15 has a tongue 18 and a socket 19 which are at a right angle to each other, and has a L-shaped vertical cross-section, as explained above. The tongue 18 has at its lateral edges a pair of upstanding flanges 20, 20 which are bent inwardly to form supporting edges 21, 21. The socket is provided at its circumferential edges with a rim 22, and also provided with a tubular boss projecting outwardly at its center. When the boss is insertedly fitted into an opening 23 formed between the lateral surface 16 and the bearing flanges 11, 11 and connector 17, the rim 22 completely covers the ends of said flanges and connector. The filler wedge may not be provided with said rim 22, but can be of a different shape so far that its boss 24 can be insertedly fitted into the above-mentioned opening 23, and consequently it can hermetically cover said opening and the ends of the bearing flanges 11, 11 and the connector 17.

In order to assure air-tightness of the window, it is advantageous to have the supporting edges 21, 21 abut against the sealing means 9.

When the window is closed, the filler wedges 15 fitted to the upper and lower ends of the joint member 3 must closely abut, at their flanges 20, against the lateral sides of the vertical panel frames 12, while the outer surfaces of its tongues 18 and the upper and lower ends of the panels 1*a*, 1*b* must abut also closely against the first sealing means 6 fitted to the upper and lower lintel rails, and while the second sealing means 9 fitted to the lateral sides of the vertical frames 12 must abut rightly and closely against the lateral sides 14 of the joint members 3.

Figure 7:
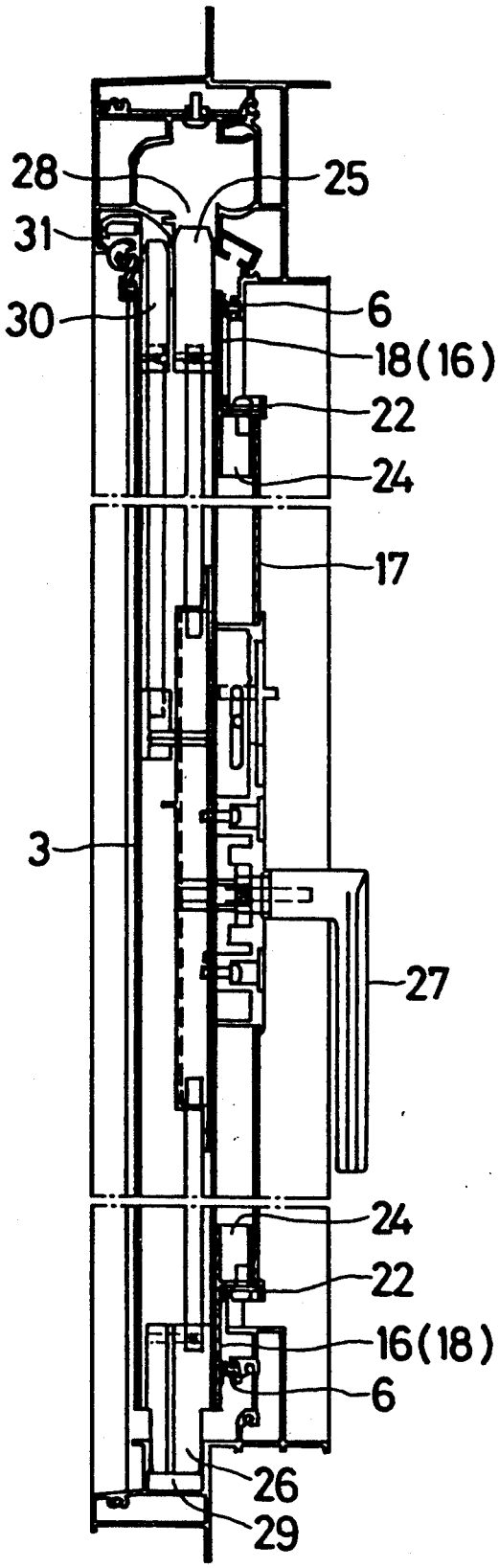
FIG. 7 is a vertical cross-sectional view of a joint member connecting panels of the window.

In order to achieve such close abutments, the panels have to be kept stretched completely in alignment with each other. Otherwise, the window will produce openings between its component panels and joint members, and its air- and water-tightness will be lost. As shown in FIG. 7 which is a vertical cross-sectional view of the window made in accordance with this invention, to the joint member 3, there are fitted at its upper end a first upper detent rod 25 and at its lower end a first lower detent rod 26. When the rods are operated by the manipulation of a handle 27, they are protrued and insertedly received respectively by a first upper guide groove 28 of the upper lintel rail and a first lower guide groove 29 of the lower rail, whereby the window is locked so as to be kept completely stretched and to keep its air-tightness. A second detent rod 30 is additionally provided to the upper end of the joint member 3, and is operatively associated with a supplemental guide piece 31 which is pivoted freely movable.

As described above, the folding window or door made in accordance with this invention is characterized by air- and water-tightening devices provided thereto which comprise the filler wedges 15 which hermetically close the openings of the joint members and, tongues 18 of which are made coplanar with the panels 1*a*, 1*b* so as to assure the smooth running of the window and to assure the closest abutment of the joint members with the first sealing means 6 of the lintel rails, and which comprise also the second sealing means 9 fitted to the lateral sides of the panels 1*a*, 1*b* which are hinged to the joint members 3 at such locations which are outside of the range within which the pannels and the joint members abut against each other at their lateral sides.

Since journals about which the panels are swiveled, are provided projectedly outside of a plane of the panels in this invention, the panels can make their swiveling movements without any intervention by the joint members. This results, differently to conventional folding doors and windows, the elimination of rounding off the angles or triming the corners of either the joint members or the pannels, and results in the close abutment of the second sealing means against the joint members. And, since the filler wedges fitted to the upper and lower ends of the joint members are coplanar with the vertical frames and the panels, they can unanimously make a close abutment with the first sealing means lined to the rails, leaving no openings therebetween. Such coplanar alignment of them can allow them as they are kept stretched to smoothly slide linearly.

I claim:

1. Air tightening devices for folding doors and windows comprising:

a) a plurality of panels selectively connected by joint members so as to be foldable about swivels supported by bearing flanges fitted to the joint members and which is characterized in that said swivels are located outside of a plane defined by said panels and said joint members when the panels are in an unfolded position.

b) filler wedges are fitted to upper and lower ends of said bearing flanges to cover said ends and are provided with extensions coplanar with said plane so as to be able to abut at from sides at lateral sides against said panels; and, c) another sealing means fitted to at least one of lateral sides of said joint members and lateral sides of said frames so as to close said sides in an airtight manner when said door is closed.

2. Air tightening device as claimed in claim 1, and wherein:

a) said extensions are shaped so as to abut against said another sealing means.

* * * * *